US006628062B1

(12) United States Patent
Nah et al.

(10) Patent No.: US 6,628,062 B1
(45) Date of Patent: Sep. 30, 2003

(54) CRT PANEL HAVING SPECIFIED INNER SURFACE ARC CURVATURES

(75) Inventors: Keon Soo Nah, Kyongsangbuk-do (KR); Hyoung Guen Park, Kyongsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 09/549,524

(22) Filed: Apr. 14, 2000

(30) Foreign Application Priority Data

Apr. 16, 1999 (KR) ..... 1999/13567

(51) Int. Cl.[7] ..... H01J 31/00; H01J 29/10; H01J 6/130

(52) U.S. Cl. ..... 313/477 R; 313/461; 220/2.1 R; 220/2.1 A

(58) Field of Search ..... 313/461, 477 R, 313/402, 408; 220/2.1 A, 2.1 R, 23 A; 445/23, 24

(56) References Cited

U.S. PATENT DOCUMENTS 4,535,907 A * 8/1985 Tokita et al. ..... 313/477 R X
4,537,322 A * 8/1985 Okada et al. ..... 220/2.1 A
5,155,410 A * 10/1992 Wakasono et al. ..... 313/408
5,506,470 A * 4/1996 Inoue et al. ..... 313/477 R
6,121,723 A * 9/2000 Sugawara et al. ..... 313/477 R
6,160,344 A * 12/2000 Cho et al. ..... 313/477 R
6,232,712 B1 * 5/2001 Pyun et al. ..... 313/477 R
6,268,690 B1 * 7/2001 Yamazaki ..... 313/461
6,274,977 B1 * 8/2001 Pyun et al. ..... 313/477 R

FOREIGN PATENT DOCUMENTS

JP 2000-149829 5/2000

* cited by examiner

*Primary Examiner*—Vip Patel
*Assistant Examiner*—Joseph Williams
(74) *Attorney, Agent, or Firm*—Birch, Stewart, Kolasch & Birch, LLP

(57) ABSTRACT

Color CRT panel including an outside surface substantially flat, and an inside surface with a desired curvature, wherein an inside surface curvature structure of the panel consists of arc curvatures having a long axis direction radius Rx of curvature and a short axis direction radius Ry of curvature different from each other, thereby improving a structural strength of the shadow mask to prevent deterioration of color reproducibility of an image.

8 Claims, 4 Drawing Sheets

CRT PANEL HAVING SPECIFIED INNER SURFACE ARC CURVATURES

BACKGROUND OF THE INVENTION

1. Field of the Invention

The present invention relates to a color CRT Cathode Ray Tube), and more particularly, to a color CRT panel which forms a front surface of a CRT for displaying an image.

2. Background of the Related Art

The CRT forms an important part for displaying an image thereon in a display, such as a TV receiver or a computer monitor. FIG. 1 illustrates a side view inclusive of a partial section of a color CRT.

Referring to FIG. 1, there is a fluorescent film 1*a* on an inside surface of a panel 1 which forms a front surface of the CRT having red, green and blue fluorescent materials coated thereon, a funnel 2 at rear of the panel 1 frit glass welded to the panel 1, and an electron gun 4 provided in a neck portion 2*a* of the funnel 2. And, there is a shadow mask 5 fastened to a frame 6 close to the fluorescent film 1*a* on an inner side of the panel 1 for selecting a color of electron beams 3. The frame 6 is hung from the sidewall of the panel 1 by a support spring 8 having one end fastened thereto and the other end inserted to a stud pin 1*b* fastened to a sidewall of the panel 1. And, there is an inner shield 7 fastened to the frame 6 by a fastening spring on one side of the frame 6 for protecting the electron beams 3 traveling toward the fluorescent film 1*a* from an external geomagnetic field. There is a deflection yoke 10 attached to an outer circumferential surface of the neck portion 2*a* having a plurality of poles for correcting a locus of travel of the electron beams 3 so that the electron beams 3 exactly hit a desired fluorescent material, and a reinforcing band 9 on an outer circumferential surface of the CRT for preventing breakage of the CRT from an external impact during operation of the CRT. Within a basic structure of the CRT, the shadow mask 5, formed to have a required curvature and disposed to have a required space from the panel 1, forms a panel assembly with the panel, so that the three electron beams 3 emitted from the electron gun 4 exactly hit onto the fluorescent material on an inside surface of the panel through the shadow mask 5, to reproduce an image. Accordingly, an accurate curvature design of the shadow mask 6 is required for implementing an exact image, for which an inner curvature of the panel 1 is considered as a precondition of the curvature design.

FIG. 2 illustrates a cross section of a panel assembly, referring to which a relation between a panel inside surface curvature and a curvature of the shadow mask will be explained.

Referring to FIG. 2, the panel 1 has an inside/an outside curved surfaces, radius Ro of the outside surface and radius Ri of the inside surface have Ro>Ri relation, for withstanding a force caused by a pressure difference between the atmospheric pressure and a high vacuum in a Braun tube. The inside surface curvature Ri of the panel 1 is considered to be the most important factor for determining a curvature of the shadow mask 5, and the curvature of the shadow mask 5 determined herein has close relations with a structural strength, and thermal deformation characteristics of the shadow mask 5. As shown in FIG. 3, the inside surface curvature Ri of the panel 1 has an arc curvature shown in a solid line and a super arc curvature shown in dashed line. The super arc curvature exhibits a height displacement of the shadow mask less than the arc curvature, according to which the super arc curvature is effective to a thermal deformation of the shadow mask 5. Accordingly, through the arc curvature and the super arc curvature are applied to the related art CRT without any particular distinction, the super arc curvature is used more when a thermal deformation characteristic is taken into consideration. Currently, the outside surface curvature Ro is designed to be greater than 40,000 mm for forming the outside surface of the panel 1 to be flat perfectly or close to the perfect flat, which causes the inside surface curvature Ri dependent on the outside surface curvature Ro of the panel 1, together with an increase a curvature of the shadow mask 5 which is dependent on the inside surface curvature Ri. As explained, the greater the curvature of the shadow mask 5, though the more effective to a thermal deformation, the worse to a strength of the shadow mask 5. Accordingly, howling is occurred, in which an image is shaken by an impact, or speaker sound, and a poor color reproducibility is caused, in which a color of the image is changed partially. Currently, since the thermal deformation is solved, not by a method of the curvature of the shadow mask 5, but by other method, i.e., by a method in which a reflection film (not shown) is coated on a surface the electron beams 3 hit thereon for reflecting thermal ions, a method for reinforcing the structural strength of the shadow mask is required.

SUMMARY OF THE INVENTION

Accordingly, the present invention is directed to a color CRT panel that substantially obviates one or more of the problems due to limitations and disadvantages of the related art.

An object of the present invention is to provide a color CRT panel which has a structure of an inside surface curvature that can reinforce a structural strength of the shadow mask.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the color CRT panel includes an outside surface substantially flat, and an inside surface with a desired curvature, wherein an inside surface curvature structure of the panel consists of arc curvatures having a long axis direction radius $R_x$ of curvature and a short axis direction radius $R_y$ of curvature different from each other.

$$\frac{T_c + \left(R_y - \sqrt{R_y^2 - L_{ye}^2}\right)}{T_c}$$

is within a range greater than 1.5 and smaller than 2.5, where, $$R_y = \frac{\sqrt{L_{ye}^2 + Z_{ye}^2}}{2 \times Z_{ye}}$$

Tc denotes a thickness of a center portion of the panel, $L_{ye}$ denotes a distance from the center portion of the panel to an end of an effective surface in a short axis direction, and Zye denotes a height at the end of the effective surface in the short axis direction.

$R_x/R_y$ is preferably within a range of 2.2–2.8.

$F'(r)=(a+b\cdot R+c\cdot R^2)\cdot r\pm(d+e\cdot L_e+f\cdot L_{e2})$, and $F'(r)=(a+b\cdot R_x+c\cdot R_x2)\cdot r\pm(d+e\cdot L_{xe}+f\cdot L_{xe}^2)$, when 'r' is on the long axis (X-axis), and $F'(r)=(a+b\cdot R_y+c\cdot R_y^2)\cdot r\pm(d+e\cdot L_{ye}+f\cdot L_{ye}^2)$, when 'r' is on the short axis (Y-axis), wherein the constants "a, b, c, d, e, and f" in both of F'(r) for the long axis and the short axis have the following values.

a=1.17146E−03, b=−4.11994E−07, c=4.53728E−11, d=4.82475E−02, e=−2.36837E−04, and f=3.78612E−07

The panel inside surface curvature meets a range of dispersion of the primary derivative F'(r) dependent on the constants "a, b, c, d, e, and f", a radius of curvature $R_x$ or $R_y$, and a distance $L_{xe}$ or $L_{ye}$.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
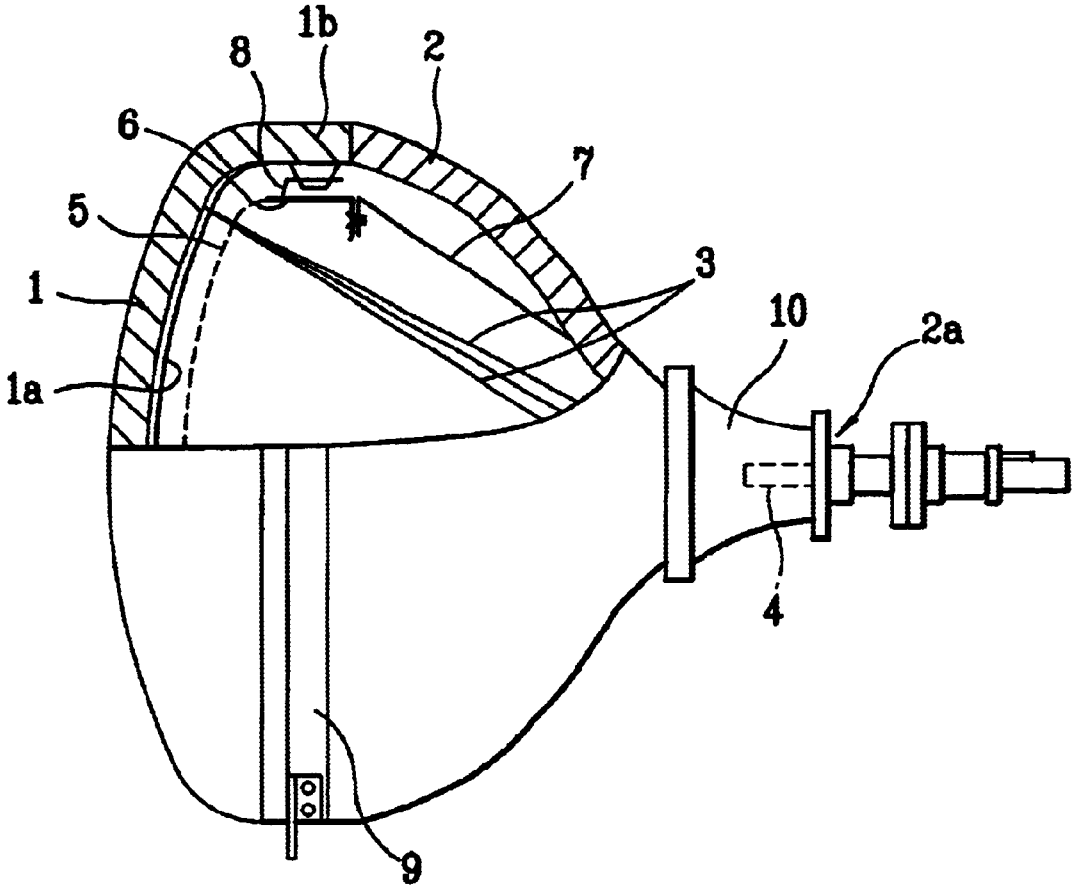
FIG.1 Prior Art
FIG. 1 illustrates a side view inclusive of a partial section of a related art color Braun tube.
Figure 2:
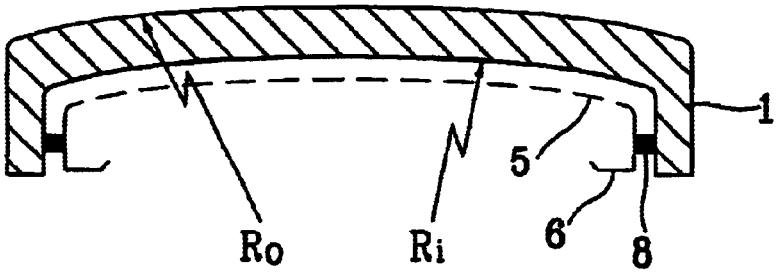
FIG.2 Prior Art
FIG. 2 illustrates a section showing a panel assembly of a color CRT.
Figure 3:
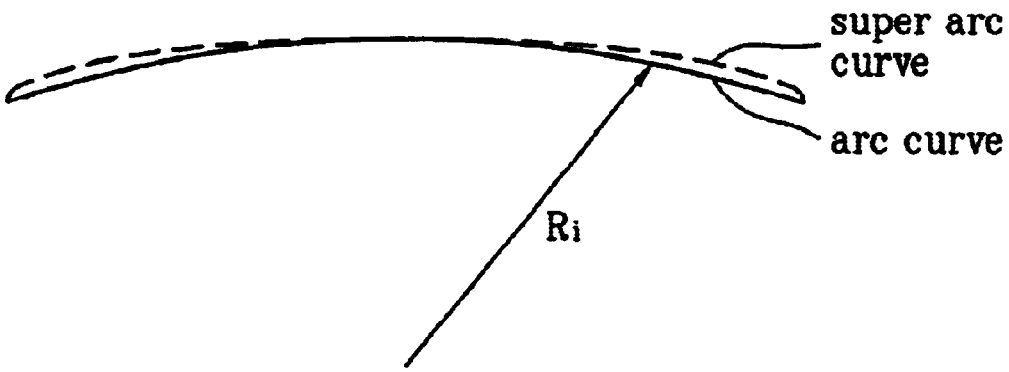
FIG. 3 illustrates a comparison of a related art arc curvature and a super arc curvature, schematically.
Figure 4:
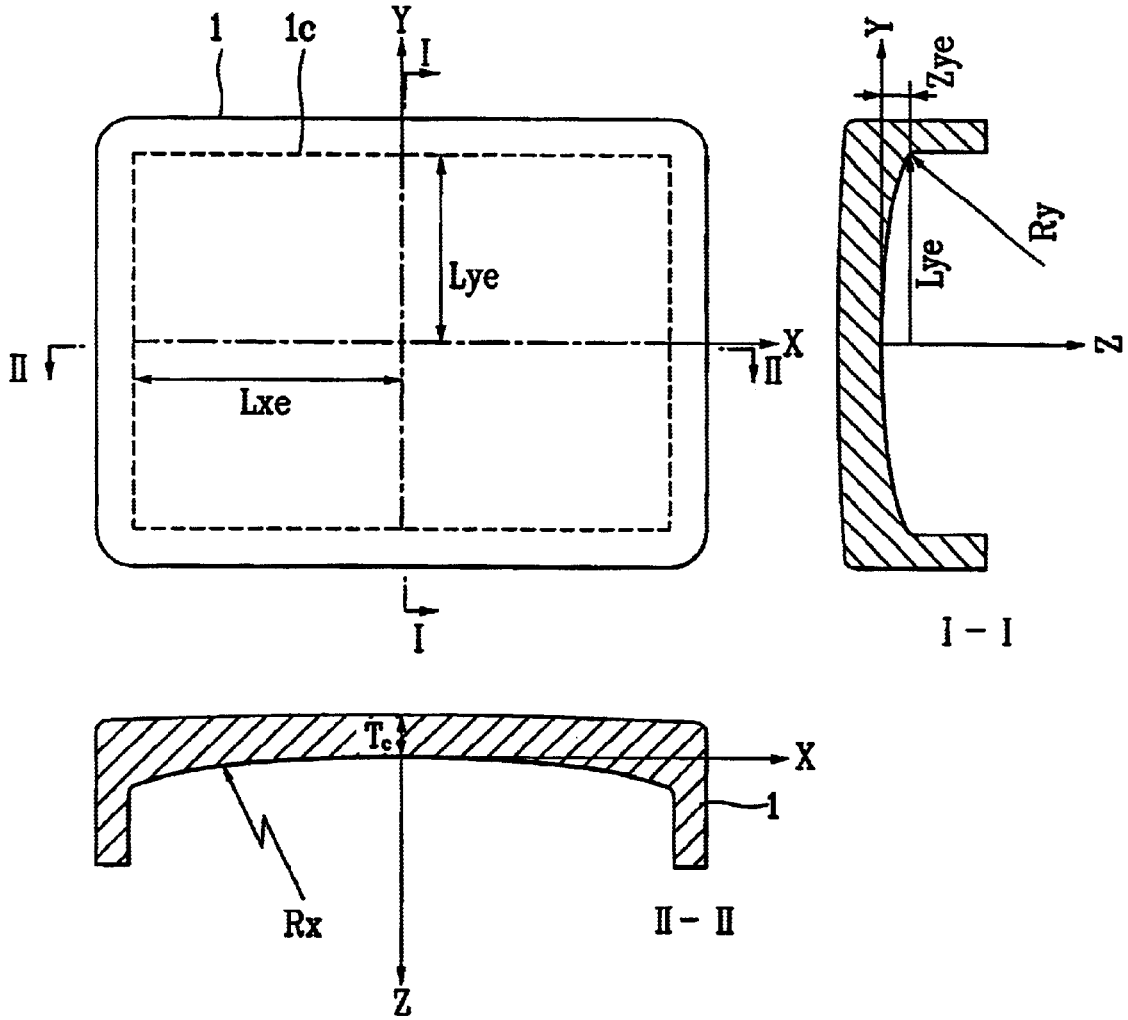
FIG. 4 illustrates a curvature structure of an inside surface of a panel, schematically; and, FIG. 5 illustrates graphs showing primary derivatives of a super arc curvature function and an arc curvature function with respect to a distance from a center of a panel.

Reference will now be made in detail to the preferred embodiments of the present invention, examples of which are illustrated in the accompanying drawings. In explanation of embodiments of the present invention, the same reference symbols and names will be given to identical components, and no additional explanations will be given to the identical components. FIG. 4 illustrates a curvature structure of an inside surface of a panel, schematically.

Referring to FIG. 4, a geometry of a panel 1 may be represented with three axes in a three dimensional space, i.e., a long axis (X-axis), a short axis (Y-axis) and a height axis (Z-axis). An origin of the axes is set at a center of an inside surface of the panel 1. $R_x$, and $R_y$ represent radiuses of curvatures of the inside surface of the panel 1 in the long axis direction and the short axis direction respectively, and $L_{xe}$ and $L_{ye}$ represent distances from the center of the panel 1 to ends of effective surfaces 1*c* in the long axis direction and in the short axis direction, respectively. And, Tc represents a thickness at a center portion of the panel 1. The $R_x$ and $R_y$ are dependent on a curvature function for a point on an inside surface of the panel 1. In the related art CRT having a curved outside panel 1 surface, an inside surface of the panel 1 is designed such that the inside surface has a full spherical surface structure in which a radius of curvature Rx in the long axis direction and the radius of curvature in the short axis direction are the same. However, in a current CRT having an outside surface which is fully, or substantially flat, the inside surface of the panel 1 has a long axis direction radius of curvature Rx different from a short axis direction radius of curvature $R_y$ due to a design problem. And, in order to improve the structural strength of the shadow mask 5 having a curvature dependent on the curvature of the inside surface of the panel 1, it is preferable that an arc curvature which has a relatively smaller curvature compared to a super arc curvature is applied to the inside surface of the panel 1. According to this, different arc curvatures are applied to the long axis direction and the short axis direction of the inside surface of the panel 1 of the present invention. As the arc curvatures are identical, radius of curvatures at identical coordinates are the same. That is, the radiuses of curvatures Rx on the long axis (X-axis) are the same regardless of a position on the long axis (X-axis), and the radiuses $R_y$ of curvatures on the short axis (Y-axis) are also alike.

Separate from the arc curvature, the long axis direction radius of curvature Rx and the short axis direction radius of curvature $R_y$ for the inside surface of the panel 1 should be optimized in view of a vacuum strength of the CRT and a structural strength of the shadow mask 5. Design criteria for optimizing the long axis direction radius of curvature $R_x$ and the short axis direction radius of curvature $R_y$ for the inside surface of the panel 1 will be explained. The short direction radius $R_y$ of curvature for the inside surface of the panel 1 can be expressed as follows.

$$\frac{T_c+\left(R_y-\sqrt{R_y^2-L_{ye}^2}\right)}{T_c} \tag{1}$$

The above equation (1) represents a ratio of thickness increase of the panel inside surface at the end of the effective surface 1*c* to a thickness Tc of the panel inside surface at a center of the panel 1 in a direction of the height axis (Z-axis) in the short axis direction (Y-axis). In this instance, the short axis direction radius $R_y$ of curvature can be expressed as follows when Zye denotes a height at the end of the effective surface 1*c* in the short axis direction.

$$R_y=\frac{\sqrt{L_{ye}^2+Z_{ye}^2}}{2\times Z_{ye}} \tag{2}$$

In this instance, since a peripheral thickness of the panel 1 is thin relatively if the equation has a value below 1.5, a strength of the CRT against an internal vacuum is weak. And, opposite to this, if the equation has a value greater than 2.5, a peripheral thickness of the panel 1 is too thick, with a poor heat conductivity, that causes a thermal stress coining from a temperature difference between an outside surface and an inside surface of the panel 1 to cause breakage of during fabrication or operation. Therefore, it is preferable that the equation (1) has a value in a range greater than 1.5 and smaller than 2.5.

In the meantime, the long axis direction radius $R_x$ of curvature should be set to have a fixed ratio to the short axis direction radius $R_y$ of curvature. If the ratio $R_x/R_y$ is below 2.2, a strength of the panel 1 drops, and the structural strength of the shadow mask 5 also drops since the curvature of the shadow mask 5 is also designed the same with the curvature of the panel inside surface. And, if the ratio $R_x/R_y$ is greater than 2.8, a long axis direction strength of the shadow mask 5 is weak against an external impact because the long axis direction curvature of the panel inside surface is relatively greater compared to the short axis direction. Accordingly, it is preferable that the ratio $R_x/R_y$ is within a range of 2.2–2.8. And, as has been explained, the radius of curvature is dependent on the curvature function of the panel inside surface, it is preferable that the curvature function 'F' of the panel inside surface is set according to the optimized radiuses of curvatures $R_x$ and $R_y$.

Since such a curvature function of a panel inside surface includes high order terms, in which case a primary derivative of the curvature function 'F' provides an easier method of approach to the optimization of the curvature function 'F'. In order to do this, primary derivatives 'F" of a super arc curvature function and an arc curvature function with respect to a distance from the center of the panel 1 are shown in FIG. 5.

Figure 5:
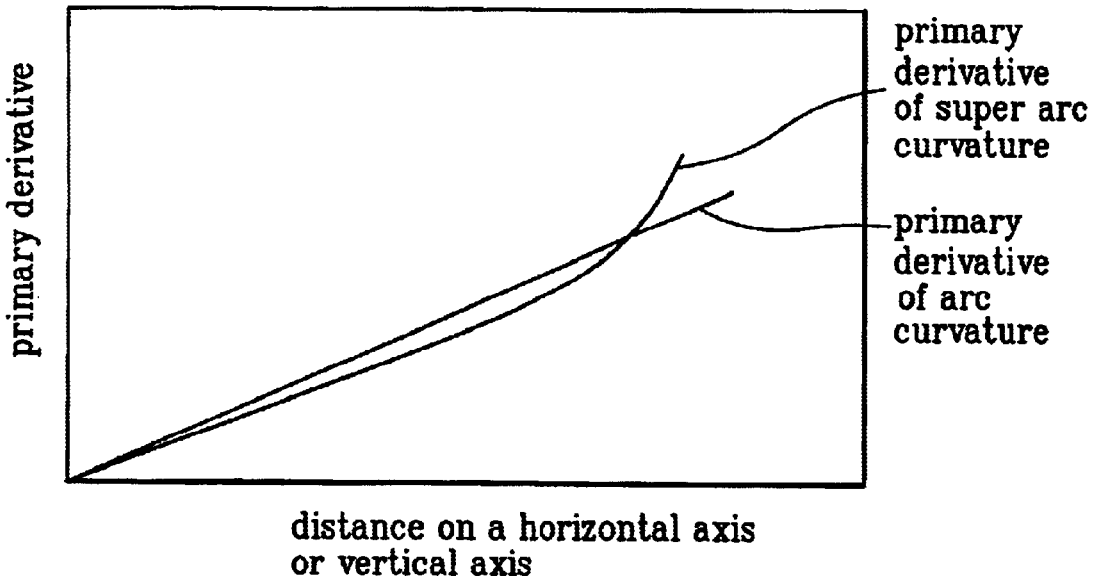

Referring to FIG. 5, primary derivatives 'F" for the arc curvatures applied to the present invention are linear functions. Accordingly, the primary derivatives 'F" can be expressed as linear functions with respect to a coordinate 'r', where 'r' denotes a coordinate of any point on a panel inside surface and 'α' is a coefficient.

$$F'(r)=\alpha\cdot r \tag{3}$$

where, the primary derivative F'(r) shows a dispersion coming from fabrication process and the deflection yoke, and, when β is a constant the dispersion taken into consideration, the primary derivative F'(r) may be defined as follows.

$$F'(r)=\alpha\cdot r\pm\beta \tag{4}$$

On the other hand, the coefficient 'α' in the primary derivative F'(r) can be defined as a function related to the radius of curvature in view of the geometry of the panel inside surface, which may be expressed as follows, if 'a', 'b', and 'c' are constants and 'R' is a radius of curvature at a point on the panel inside surface.

$$\alpha=a+b\cdot R+c\cdot R^2 \tag{5}$$

And, alike the case of the coefficient 'α', the coefficient 'β' of the primary derivative F'(r) can be defined as a function dependent on the distance $L_e$, which may be expressed as follows, if 'd', 'e', and 'f' are constants and Le is a distance from the panel center to the end of the effective surface 1*c* in any direction.

$$\beta=d+e\cdot L_e+f\cdot L_e^2 \tag{6}$$

Accordingly, the primary derivative F'(r) may be expressed according to equations (5) and (6) as follows.

$$F'(r)=(a+b\cdot R+c\cdot R^2)\cdot r\pm(d+e\cdot L_e+f\cdot L_e^2) \tag{7}$$

When the point 'r' is positioned on the long axis X-axis and the short axis Y-axis, the primary derivatives F'(r) of curvature functions for the long axis direction and the short axis direction radiuses of curvatures may be expressed as the following equations (8) and (9).

$$F'(r)=(a+b\cdot R_x+c\cdot R_x^2)\cdot r\pm(d+e\cdot L_{xe}+f\cdot L_{xe}^2) \tag{8}$$

$$F'(r)=(a+b\cdot R_y+c\cdot R_y^2)\cdot r\pm(d+e\cdot L_{ye}+f\cdot L_{ye}^2) \tag{9}$$

In the primary derivatives F'(r), the constants "a, b, c, d, e, and f" should be fixed to suit to the radiuses of curvatures $R_x$ and $R_y$ and the distances $L_{xe}$ and $L_{ye}$ having their ranges fixed according to the foregoing conditions. Accordingly, it is preferable that the constants "a, b, c, d, e, and f" for both of the primary derivatives F'(r) of the long axis and short axis curvature functions are set to be a=1.17146E−03, b=4.11994E−07, c=4.537282E−11, D=4.82475E−02, e=−2.36837E−04, f=3.78612E−07. And, it is preferable that a curvature of the panel inside surface meets a dispersion range of the primary derivative determined by the constants "a, b, c, d, e, and f", radius of curvature $R_x$ and $R_y$, and distance $L_{xe}$ and $L_{ye}$.

As has been explained, since the panel 1 of the present invention is formed of an inside surface curvature structure of an arc curvature optimized by the foregoing equations, a structural strength of the shadow mask 5 having a curvature structure dependent on the inside surface curvature structure can be improved. Eventually, the improvement of howling caused by the strength improved shadow mask prevents deterioration of a color reproducibility coming from impact during operation of the CRT and a speaker sound.

It will be apparent to those skilled in the art that various modifications and variations can be made in the color CRT panel of the present invention without departing from the spirit or scope of the invention. Thus, it is intended that the present invention cover the modifications and variations ofthis invention provided they come within the scope of the appended claims and their equivalents.

What is claimed is:

1. A color CRT (Cathode Ray Tube) panel comprising:

an outside surface substantially flat; and an inside surface formed with arc curvatures having a long axis direction radius of curvature $R_x$ and a short axis direction radius of curvature $R_y$ different from each other, wherein the radius $R_x$ is greater than the radius $R_y$, and wherein $$\frac{T_c+\left(R_y-\sqrt{R_y^2-L_{ye}^2}\right)}{T_c}$$

represents a ratio of thickness increase of the panel inside surface at the end of an effective panel inside surface to a thickness $T_c$ of the panel inside surface at a center of the panel in a direction of a height axis in the short axis direction $R_y$, wherein the ratio is within a range of greater than 1.5 and smaller than 2.5, and $$R_y=\frac{\sqrt{L_{ye}^2+Z_{ye}^2}}{2\times Z_{ye}},$$

where $L_{ye}$ denotes a distance from the center portion of the panel to an end of an effective surface in a short axis direction, and $Z_{ye}$ denotes a height at the end of the effective surface in the short axis direction.

2. A color CRT panel as claimed in claim 1, wherein $R_x/R_y$ is within a range of 2.2–2.8.

3. A color CRT panel as claimed in claim 2, wherein the primary derivative F' of a curvature function F of the panel inside surface is a linear function of a coordinate 'r', which is expressed as F'(r)=α·r±β, where 'r' denotes a coordinate of a point on the panel inside surface, 'α' denotes a coefficient, and β denotes a coefficient having dispersion caused by a fabrication process and a deflection yoke taken into consideration, wherein '$\alpha$' is a function dependent on 'R', which is expressed as $\alpha=a+b\cdot R+c\cdot R^2$, where "a, b, and c" are constants, and 'R' denotes a radius of curvature at a point on the panel inside surface, and wherein '$\beta$' is function dependent on '$L_e$', which is expressed as $\beta=d+e\cdot L_e+f\cdot L_e^2$, where "d, e, and f" are constants, and '$L_e$" denotes a distance from the center of the panel to an end of the effective surface in one direction.

4. A color CRT panel as claimed in claim 3, wherein $F'(r)=(a+b\cdot R_x+c\cdot R_x^2)\cdot r\pm(d+e\cdot L_{xe}+f\cdot L_{xe}^2)$, when 'r' is on the long axis (X-axis), and wherein the constants "a, b, c, d, e, and f" in both of F'(r) for the long axis and the short axis have the following values:

a=1.17146E−03,
b=−4.11994E−07,
c=4.53728E−11,
d=4.82475E−02,
e=−2.36837E−04, and
f=3.78612E−07.

5. A color CRT panel as claimed in claim 4, wherein the panel inside surface curvature meets a range of dispersion of the primary derivative F'(r) dependent on the constants "a, b, c, d, e, and f", a radius of curvature $R_x$ or $R_y$, and a distance $L_{xe}$ or $L_{ye}$.

6. A color CRT panel as claimed in claim 3, wherein $F'(r)=(a+b\cdot R_y+c\cdot R_y^2)\cdot r\pm(d+e\cdot L_{ye}+f\cdot L_{ye}^2)$, when 'r' is on the short axis (Y-axis), and wherein the constants "a, b, c, d, e, and f" in both of F'(r) for the long axis and the short axis have the following values:

a=1.17146E−03,
b=−4.11994E−07,
c=4.53728E−11,
d=4.82475E−02,
e=−2.36837E−04, and
f=3.78612E−07.

7. A color CRT panel as claimed in claim 6, wherein the panel inside surface curvature meets a range of dispersion of the primary derivative F'(r) dependent on the constants "a, b, c, d, e, and f", a radius of curvature $R_x$ or $R_y$, and a distance $L_{xe}$ or $L_{ye}$.

8. A color CRT (Cathode Ray Tube) panel comprising:

an outside surface which is substantially flat; and an inside surface formed with arc curvatures having a long axis direction radius of curvature $R_x$ and a short axis direction radius of curvature $R_y$ different from each other, wherein $R_x/R_y$ is within a range of from 2.2–2.8.

* * * * *